United States Patent [19]

Gangelhoff

[11] 4,048,760

[45] Sept. 20, 1977

[54] SCISSORS SHARPENER

[76] Inventor: Fred R. Gangelhoff, 1691 Lake Ave., Largo, Fla. 33540

[21] Appl. No.: 705,562

[22] Filed: July 15, 1976

[51] Int. Cl.[2] ..... B24B 3/52

[52] U.S. Cl. ..... 51/116; 51/285

[58] Field of Search ..... 51/116, 111 R, 80 R, 51/80 BS, 210, 285; 76/82.2

[56] References Cited

U.S. PATENT DOCUMENTS

| | | | |
|---|---|---|---|
| 153,677 | 8/1874 | Ilingworth | 51/111 R |
| 1,027,005 | 5/1912 | Seymour | 51/116 |
| 1,078,508 | 11/1913 | Loomis | 51/80 R |
| 1,184,517 | 5/1916 | Burt | 51/285 |
| 1,963,422 | 6/1934 | Scott | 76/82.2 |
| 2,228,385 | 1/1941 | Burns | 51/80 R |
| 2,451,203 | 10/1948 | DeTray | 76/82.2 |

*Primary Examiner*—Al Lawrence Smith
*Assistant Examiner*—Nicholas P. Godici
*Attorney, Agent, or Firm*—Clarence A. O'Brien; Harvey B. Jacobson

[57] ABSTRACT

A pair of slightly peripherally overlapped and axially spaced rotary grinding members are provided and journalled for rotation about generally parallel axes of rotation. The peripheral portions of the remote axial faces of the grinding members are oppositely bevelled and rotary torque producing structure is provided and drivingly coupled to the grinding members for driving the latter in opposite directions of rotation. Further, structure is provided defining oppositely facing substantially co-planar bearing surfaces on opposite sides of and disposed substantially normal to a plane normal to the axes of rotation of the rotary grinding members and disposed between the overlapped portions of the rotary grinding members. The bearing surfaces are disposed in generally equal chord planes of the rotary grinding members spaced substantially equally from and paralleling the axes of rotation of the rotary grinding members.

9 Claims, 4 Drawing Figures

SCISSORS SHARPENER

BACKGROUND OF THE INVENTION

Various forms of scissors sharpeners have been heretofore designed. Some forms of scissors sharpeners are constructed in a manner enabling only one blade of a pair of scissors to be sharpened at a time and other forms of scissors sharpeners are constructed in a manner enabling both blades of scissors to be sharpened at the same time. In addition, some forms of scissors sharpeners are constructed in a manner whereby the blades of scissors to be sharpened must be repeatedly manually passed over a sharpening device and other forms of scissors sharpeners are constructed including motor driven rotary grinding members over which the blades of scissors to be sharpened need be passed only two or three times. However, there are relatively few powered rotary grinding structures constructed in a manner to enable both blades of scissors to be sharpened at the same time. In addition, these forms of powered scissors sharpeners are not constructed in a manner whereby a pair of scissors to be sharpened may be manually manipulated to swing the blades of the scissors together in the usual cutting manner while simultaneously passing the blades of the scissors over powered rotary grinding members.

Examples of the above referred to previously known scissors sharpeners including some of the general structural features of the instant invention are disclosed in U.S. Pat. Nos. 537,306, 1,535,395, 1,556,432, 1,963,422 and 3,755,971.

BRIEF DESCRIPTION OF THE INVENTION

A pair of rotary grinding members are journalled for rotation about generally parallel axes and include slightly overlapped adjacent peripheral portions. The remote axial faces of the grinding members include oppositely bevelled peripheral portions and the rotary grinding members are driven in opposite directions of rotation.

The main object of this invention is to provide a sharpener for scissors of the motor driven type and constructed in a manner whereby both blades of a pair of scissors may be simultaneously sharpened.

Another object of this invention is to provide a scissors sharpener constructed in a manner whereby scissors to be sharpened may be gripped in the usual manner and passed longitudinally over the overlapped peripheral portions of the rotary grinding members while pressure is applied to the blades of the scissors to swing the latter together.

Another important object of this invention is to provide a scissors sharpener including guide or bearing surfaces positioned for engagement by both blades of scissors to be sharpened and operative to define proper positioning of the blades of scissors being sharpened relative to the rotary grinding members.

A final object of this invention to be specifically enumerated herein is to provide a scissors sharpener in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
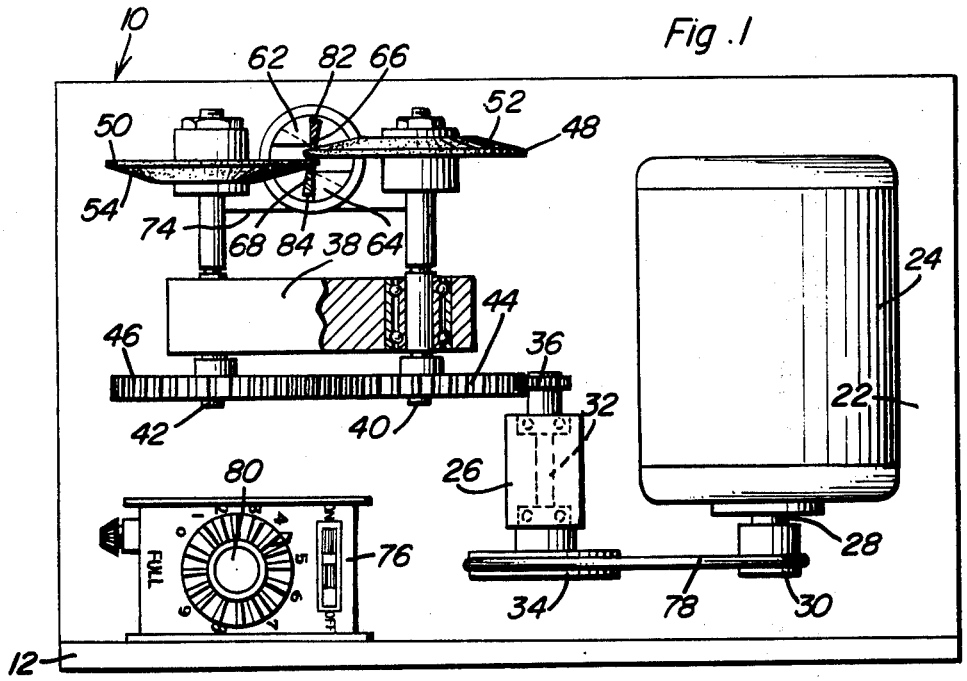
FIG. 1 is a front elevational view of the scissors sharpener.

Referring now more specifically to the drawings the numeral 10 generally designates the scissors sharpener of the instant invention. The scissors sharpener 10 includes a horizontal base 12 which is generally rectangular in plan shape and includes front and rear longitudinal marginal portions 14 and 16 as well as opposite end marginal portions 18 and 20. The base 12 includes and upstanding side 22 extending along and projecting upwardly from the rear marginal portion 16 and the side 22 supports an electric motor 24 and journal block 26 on its forward surface. The motor 24 includes an upstanding and downwardly projecting rotary output shaft 28 upon which a small diameter pulley 30 is mounted and an upstanding shaft 32 is journalled from the journal block 26 and has a large diameter pulley 34 mounted on its lower end below the block 26 and a small diameter gear wheel 36 mounted on its upper end above the journal block 26.

A second journal block 38 is also supported on the front side of the side 22 and rotatably journals a pair of parallel upstanding shafts 40 and 42 therefrom. The lower ends of the shafts 40 and 42 have meshed gear wheels 44 and 46 mounted thereon and the gear wheel 36 is meshed in driving engagement with the gear wheel 44. The upper ends of the shafts 40 and 42 have a pair of rotary grinding members or wheels 48 and 50 removably mounted thereon and the grinding wheels 48 and 50 include adjacent overlapped peripheral portions. In addition, the remote axial faces of the grinding wheels 48 and 50 include oppositely bevelled peripheral portions 52 and 54.

The rear side 22 is provided with a front to rear extending bore 55 and the threaded shank portion 56 of a guide block 58 is secured through the bore 55 in angularly adjusted position therein by means of a threaded hand nut 60 and thereby supports the guide block 58 in adjusted angular position projecting forwardly of the side 22. The guide block 59 includes upper and lower forwardly projecting arms 62 and 64 which are vertically spaced apart and receive the overlapped portions of the adjacent peripheral portions of the grinding wheels 48 and 50 therebetween. The arms 62 and 64 define substantially co-planar abutments surfaces 66 and 68 at their free ends and the surfaces 66 and 68 extend a short distance rearwardly from the free ends of the arms 62 and 64 and then twist downwardly and upwardly, respectively, away from each other as at 70 and 72. Also, the rear side 22 includes an opening 74 formed therethrough below the grinding wheels 48 and 50 and in front to rear alignment with the overlapped adjacent peripheral portions of the grinding wheels.

The electric motor 24 is electrically connected to a suitable source (not shown) of electrical potential through an adjustable variable speed control 76 whereby the speed of rotation of the output shaft 28 and thus the grinding wheels 48 and 50 may be varied as desired. The maximum speed of rotation of the rotary output shaft 28 determines the gear reduction of the drive assembly through which the electric motor 24 is drivingly coupled to the shafts 40 and 42, the pulley 30 being drivingly connected to the pulley 34 by means of an endless flexible drive member 78. In addition, the sharpener 10 may be provided with a shroud enclosing the motor 24, the drive train by which the rotary output shaft 28 is drivingly coupled to the shafts 40 and 42 and the control 76, except for the control knob portion 80 thereof which will be disposed outwardly of the shroud for ease of adjustment.

Figure 2:
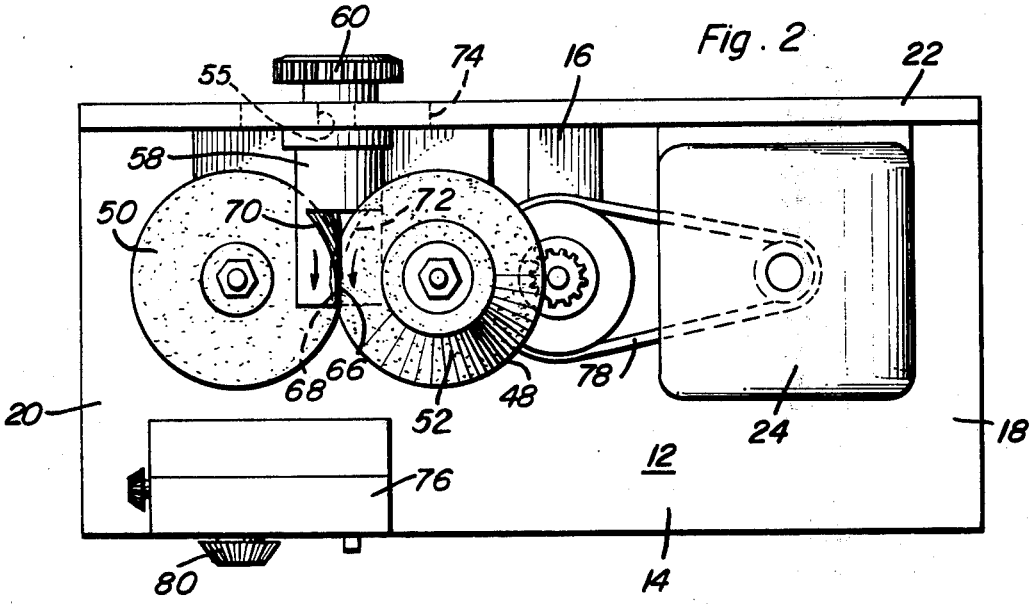
FIG. 2 is a top plan view of the scissors sharpener.
Figure 3:
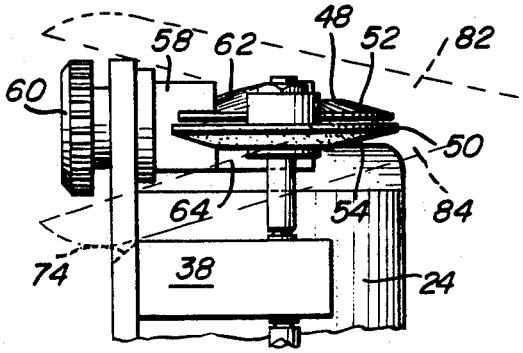
FIG. 3 is a fragmentary side elevational view of the scissors sharpener as seen from the left side of FIGS. 1 and 2.
Figure 4:
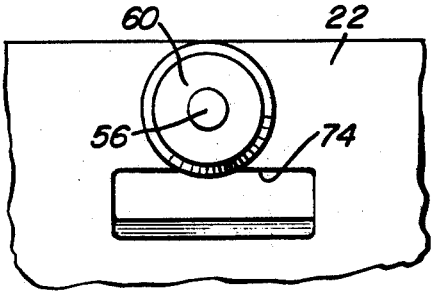
FIG. 4 is a fragmentary rear elevational view of the scissors sharpener.

In operation, a pair of scissors to be sharpened is manually gripped in the usual manner and manipulated to spread the blades 82 and 84 thereof apart in the manner illustrated in FIG. 3 of the drawings by phantom lines. Then, the scissors may be positioned with the blades 82 and 84 engaged with the surfaces 66 and 68 and the root ends of the blades 82 and 84 engaged with the bevelled peripheral axial faces 52 and 54 of the grinding wheels 48 and 50. Thereafter, the scissors are manipulated to urge the free ends of the blades 82 and 84 together while longitudinally advancing the blades 82 and 84 to the right as viewed in FIG. 3 of the drawings. If the blades 82 and 84 are long, the free end of the blade 84 will be received through the opening 74. Further, if the blades 82 and 84 are curved, the surfaces 70 and 72 provide clearance for such curved blades, whether the scissors blades be curved to the right or to the left as viewed in FIG. 2.

If it is desired, several passes of the blades 82 and 84 over the bevelled peripheral faces 52 and 54 of the grinding wheels 48 and 50 may be made. In any event, the sharpener 10 is capable of sharpening conventional scissors with straight blades or curved blades and the blades of scissors being sharpened may curve either toward the right or toward the left.

Further, the bevel of the sharpened edges of the blades of the scissors may be varied by loosening the hand nut 60, slightly angularly displacing the shank portion 56 and then re-tightening the hand nut 60. Also, the double journal block 38 may be replaced by a pair of spaced journal blocks, if additional clearance is needed for the lower blade being sharpened, or a single notched journal block, to straddle opening 74, may be used to provide additional blade clearance. Still further, the grinding wheels may be replaced by metal cutting wheels, if desired, to perform a bevelling operation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Scissors sharpener including a pair of slightly peripherally overlapped and axially spaced grinding members, means journaling said grinding members for rotation about generally parallel axes of rotation, said rotary grinding members including remote axial faces having outer peripheral oppositely bevelled portions, rotary torque input means drivingly connected to said grinding members for driving the latter in opposite directions, means defining oppositely facing bearing surface portions on opposite sides of a first plane normal to said axes and disposed between the overlapped portions of said grinding members, said bearing surface portions being disposed substantially in a second plane containing said axes and lying substantially in a third plane normal to said first and second planes and generally bisecting the peripherally overlapped portions of said grinding members.

2. Scissors sharpener including a pair of slightly peripherally overlapped and axially spaced grinding members, means journaling said grinding members for rotation about generally parallel axis of rotation, said rotary grinding members including remote axial faces having outer peripheral oppositely bevelled portions, rotary torque input means drivingly connected to said grinding members for driving the latter in opposite directions, means defining oppositely facing substantially co-planar bearing surface portions on opposite sides of and disposed substantially normal to a plane normal to said axes and disposed between the overlapped portions of said grinding members, said bearing surface portions being disposed in generally equal chord planes of said rotary grinding members spaced substantially equally from and paralleling said axes.

3. The combination of claim 2 wherein said bearing surface portions are disposed, at least substantially entirely, on one side of a plane containing said axes of rotation of said grinding members.

4. The combination of claim 3 wherein said bearing surface portions include coextensive curved portions disposed, at least substantially entirely, on the other side of said plane containing said axes of rotation of said grinding members, said curved portions curving toward the axes of rotation of the grinding members away from which they face.

5. The combination of claim 4 wherein said curved portions also curve away from said plane disposed between said overlapped portions of said grinding members.

6. The combination of claim 5 wherein said sharpener includes an upright structural wall from which said rotary grinding members are journalled for rotation about upstanding axes spaced outwardly of one side of and adjacent the upper marginal edge portion of said wall, said wall having a horizontal opening formed therethrough below the level of said grinding members for receiving the free end portion of a scissors blade therethrough when the base end portion of the blade is engaged with the lower overlapped grinding member portion.

7. The combination of claim 2 wherein said rotary grinding members comprise grinding stones.

8. Scissors sharpener including a pair of slightly peripherally overlapped and axially spaced grinding members, means journaling said grinding members for rotation about generally parallel axes of rotation, said rotary grinding members including remote axial faces having outer peripheral oppositely bevelled portions, rotary torque input means drivingly connected to said grinding members for driving the latter in opposite directions, said sharpener including an upright structural wall from which said rotary grinding members are journaled for rotation about upstanding axes spaced outwardly of one side of and adjacent the upper marginal edge portion of said wall, said wall having a horizontal opening formed therethrough below the level of said grinding members for receiving the free end portion of a scissors blade therethrough when the base end portion of the blade is engaged with the lower overlapped grinding member portion.

9. The combination of claim 2 wherein said means defining said bearing surface portions includes means operative to simultaneously adjustably angularly displace said bearing surface portions about an axis normal to a plane containing the axes of rotation of said grinding members.

* * * * *